US006552476B1

(12) United States Patent
Hanashi et al.

(10) Patent No.: US 6,552,476 B1
(45) **Date of Patent: *Apr. 22, 2003**

(54) SPARK PLUG FOR INTERNAL COMBUSTION ENGINE HAVING BETTER SELF-CLEANING FUNCTION

(75) Inventors: Ken Hanashi, Nagoya (JP); Yasutake Ishino, Kariya (JP); Hironori Osamura, Chiryu (JP)

(73) Assignee: Denso Corporation, Kariya (JP)

( * ) Notice: Subject to any disclaimer, the term of this patent is extended or adjusted under 35 U.S.C. 154(b) by 160 days.

This patent is subject to a terminal disclaimer.

(21) Appl. No.: 09/666,540

(22) Filed: Sep. 21, 2000

(30) Foreign Application Priority Data

Sep. 22, 1999 (JP) ..... 11-268964

(51) Int. Cl.[7] ..... H01T 13/20
(52) U.S. Cl. ..... 313/141; 313/142
(58) Field of Search ..... 313/141, 142

(56) References Cited

U.S. PATENT DOCUMENTS 5,581,145 A 12/1996 Kato et al.
5,811,915 A * 9/1998 Abe et al. ..... 313/140
5,929,556 A * 7/1999 Matsubara et al. ..... 313/139
6,064,143 A * 5/2000 Kagawa ..... 123/169 EL
6,229,253 B1 * 5/2001 Iwata et al. ..... 313/112
6,232,704 B1 * 5/2001 Herweg et al. ..... 313/141
6,316,868 B1 * 11/2001 Ishino et al. ..... 313/123

FOREIGN PATENT DOCUMENTS

| | | |
|---|---|---|
| EP | 803950 A1 | 4/1997 |
| EP | 0774813 | 5/1997 |
| EP | 964490 A2 | 12/1999 |
| EP | 0964490 | 12/1999 |
| JP | 49-120932 | 2/1948 |
| JP | 47-19236 | 9/1972 |
| JP | 53-41629 | 10/1978 |
| JP | 60-81784 | 5/1985 |
| JP | 3-50396 | 8/1991 |

* cited by examiner

*Primary Examiner*—Ashok Patel
*Assistant Examiner*—Glenn Zimmerman
(74) *Attorney, Agent, or Firm*—Nixon & Vanderhye P.C.

(57) ABSTRACT

A first gap discharge gap is located between a front end of a center electrode and a front side of a first ground electrode of a spark plug. A second discharge gap is located between a front end of a second ground electrode and a front side of the center electrode. Respective dimensional relationships between various of these elements are established to promote self-cleaning of the spark plug.

3 Claims, 7 Drawing Sheets

| C | 0.8 | 1.0 | 1.2 | 1.4 | 1.6 | 1.8 | 2.0 |
|---|---|---|---|---|---|---|---|
| SPARK DISCHARGE MODE | ○ | ○ | ○ | △ | △ | × | × |

| | | | | | | |
|---|---|---|---|---|---|---|
| E (mm) | 0 | 0 | 0 | -0.2 | -0.4 | -0.7 |
| F (mm) | 0 | -0.2 | -0.3 | -0.3 | -0.3 | -0.3 |

SPARK PLUG FOR INTERNAL COMBUSTION ENGINE HAVING BETTER SELF-CLEANING FUNCTION

CROSS REFERENCE TO RELATED APPLICATION

This application is based upon and claims the benefit of priority of Japanese Patent Application No. H.11-268964 filed on Sep. 22, 1999, the content of which is incorporated herein by reference.

BACKGROUND OF THE INVENTION

1. Field of the Invention

The present invention relates to a sparkplug for internal combustion engine having a better self-cleaning function in use of surface creeping spark discharges.

2. Description of Related Art

Recently, as environmental preservation has become more important, stratified charge internal combustion engines with lower fuel consumption have been widely used as more environmentally-friendly engines.

However, when stratified fuel mixtures are burned in a combustion chamber, rich fuel mixtures are concentrated near a spark plug so that the spark plug may tend to be smoldered or fouled by carbon. The carbon-fouling makes the insulation property of an insulator surrounding a center electrode worse so that a spark discharge may not occur across the regular discharge gap provided between center and ground electrodes but instead may occur between the insulator, on a surface of which carbon is deposited, and the inside of a metal housing for mounting at a portion deep into the metal housing from a front end surface of the insulator.

To cope with this problem, there are known self-cleaning spark plugs as disclosed in JP-Y2-53-41629 or JP-A-47-19236.

According to JP-Y2-53-41629, the spark plug has a plurality of electrodes constituting first and second ground electrodes. A first discharge gap is formed between the first ground electrode and the center electrode and a second discharge gap is formed between the second ground electrode and the center electrode. A regular spark discharge occurs through the first discharge gap and, when the insulator is fouled by carbon deposit, a spark discharge occurs through the second discharge gap, not through the portion deep into the metal housing, so that carbon may be burned without decreasing the ignition capability of the spark plug.

Further, according to JP-A-47-19236, there are provided the regular first discharge gap and the second discharge gap through which sparks are discharged when the insulator is fouled. It is characterized, in this case, that a front end of the center electrode is nearly equal in height to a front end of the insulator.

Therefore, as the spark discharge at the first discharge gap occurs at a position nearly same in height as the second discharge gap, it is contemplated that the respective ignition characteristics at both first and second discharge gaps do not have much difference.

However, the spark plug according to JP-Y2-53-41629 has a drawback in that there exists a big difference of ignitability between the respective spark discharges at the first and second discharge gaps, since the second discharge gap formed at a leading end of the metal housing is arranged at a position far away from the first discharge gap, so that drivability is adversely affected, in particular, in stratified fuel combustion.

Further, as the spark discharge at the second discharge gap occurs at a place deep from the leading end of the insulator into an insulator base, channeling is likely to occur.

On the other hand, according to the spark plug disclosed in JP-A-47-19236, there is also a problem that ignitability is not good, as the front end of the first electrode is obliged to be almost same in height as the front end of the insulator so that the front end of the insulator may operate to cool flame cores generated by spark discharge at the first discharge gap. Further, though carbon adhered to the surface of the insulator is burned by creeping discharge along the surface of the insulator through the second discharge gap, there is a problem that a channeling is likely to occur so that grooves may be formed on the surface of the insulator as shown in FIGS. 12A and 12B. FIG. 12A shows the insulator of the spark plug viewed in an axial direction of the center electrode and FIG. 12B shows the insulator in side view.

SUMMARY OF THE INVENTION

The present invention has been made in view of the above mentioned problem, and an object of the present invention is to provide a spark plug for internal combustion engines in which a remarkably longer life time of fouling resistance is secured in such a manner that an air-gap spark discharge with a good ignitabilty usually occurs at a first discharge gap and, when the insulator is fouled, a surface creeping spark discharge occurs at a second discharge gap to burn carbon deposited on the surface of the insulator, while the channeling on the surface of the insulator is limited.

To achieve the above object, the spark plug has a center electrode, first and second ground electrodes, an insulator and a metal housing. The first discharge gap is constituted between a front end of the center electrode and a front side of the first ground electrode and the second discharge gap is constituted between a front end of the second electrode and a front side of the center electrode.

In this case, dimensional relationships of the center electrode, the first and second ground electrodes, the insulator and the metal housing are respectively in ranges of, $$A \leqq (C+D)+0.5B$$

$$B \geqq 0.6 \text{ mm}$$

$$C \leqq 1.6 \text{ mm}$$

$$H \geqq 0.9 \text{ mm}$$

where

A is a distance of the first discharge gap,

B is a radial thickness of the front end of the insulator

C is a shortest distance between the insulator and the front end of the second electrode, D is a shortest distance between a base point of the center electrode where a diametrically reduced portion thereof is integrally connected to a base portion thereof and the inside front end of the insulator, and H is a distance of spark discharge creeping along the end surface of the insulator.

Further, it is preferable that dimensional relationships of the center electrode, the first and second ground electrodes, the insulator and the metal housing are respectively in ranges of, $$A \leqq (C+D)+0.5B$$

$$B \geqq 0.6 \text{ mm}$$

$C \leqq 1.6$ mm $E \leqq 0$ $-0.5\ G \leqq F \leqq 0$ $|B|+|E|+|F| \geqq 1.2$ mm where A is a distance of the first discharge gap, B is a radial thickness of the front end of the insulator, C is a shortest distance between the insulator and the front end of the second electrode, D is a shortest distance between the base point of the center electrode and the inside front end of the insulator, E is an axial length from the inside front end of the insulator to the base point of the center electrode (shown as + mark if the base point protrudes out of the inside front end of the insulator), F is an axial length from the front end of the insulator to the front end of the second electrode on a side of the housing (shown as + mark if the front end of the second electrode on a side of the housing protrudes out of the front end of the insulator, and G is an axial thickness of the front end of the second electrode.

To realize a spark plug having a longer consumption life time, it is preferable that at least one of the front end of the first ground electrode and the front end of the center electrode is provided with a noble metal chip preferably made of any one material of pure Pt, pure Ir, Pt alloy and Ir alloy.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
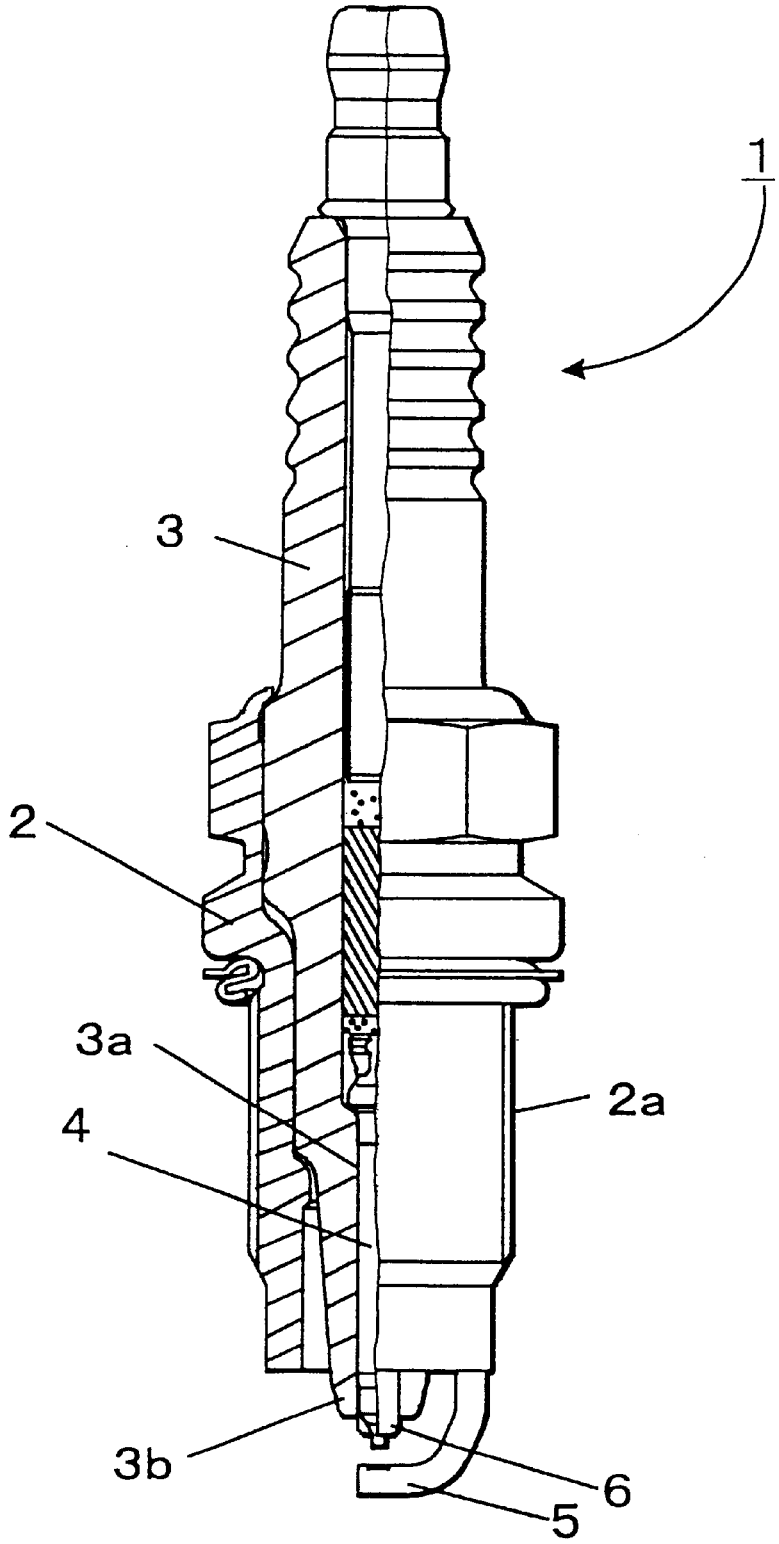
FIG. 1 is a semi cross sectional elevation view of a spark plug according to a first embodiment of the present invention.
Figure 2:
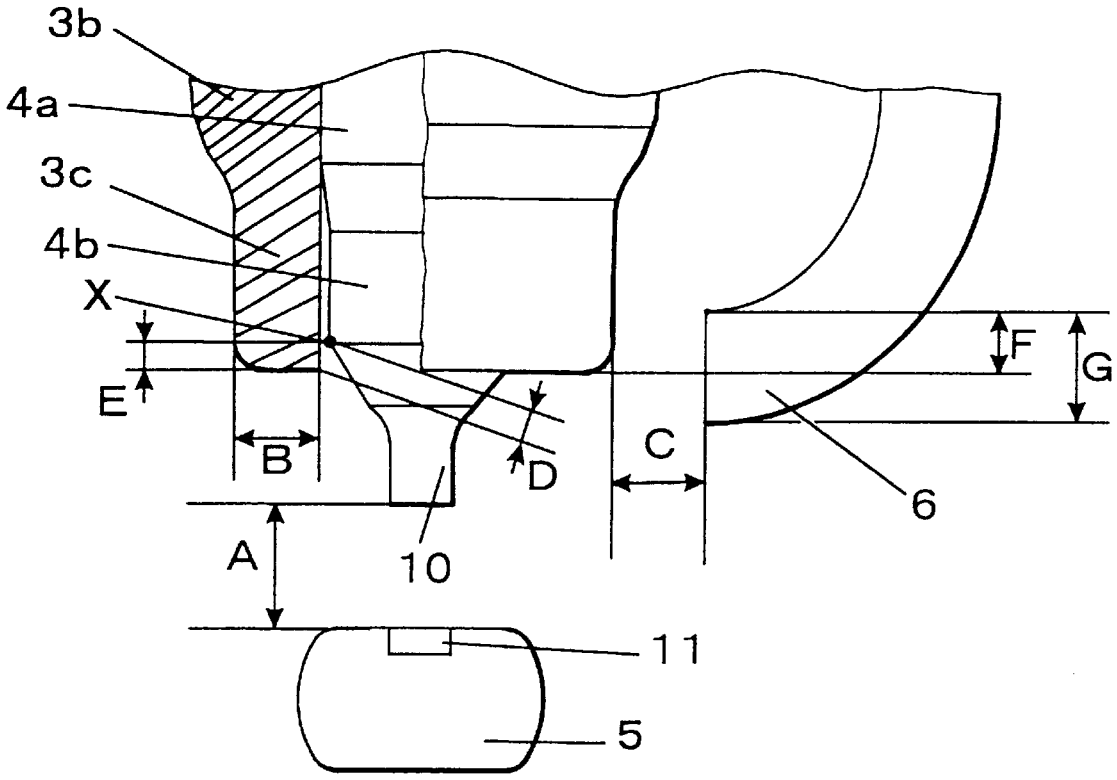
FIG. 2 is a partly enlarged elevation view of the spark plug of FIG. 1.
Figure 3:
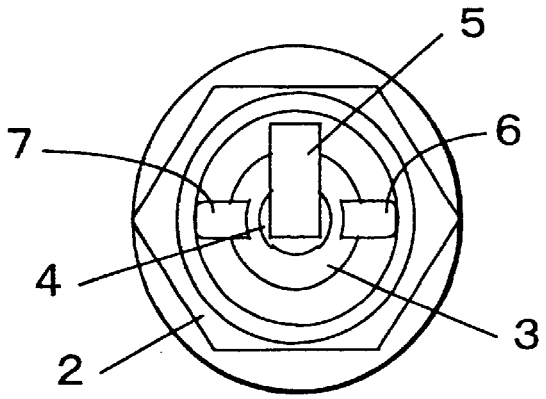
FIG. 3 is a front view of the spark of FIG. 1.

FIGS. 1 to 3 show a spark plug for internal combustion engines according to a first embodiment of the present invention. The spark plug 1 has a tubular metal housing 2 having a thread 2*a* for mounting to an engine cylinder block (not shown). An insulator 3 made of alumina ceramics ($Al_2O_3$) is fitted into the housing 2 and a leading end portion 3*b* of the insulator 3 is exposed out of the front end of the housing 2. A center electrode 4 is inserted and fixed at a through hole 3*a* of the insulator 3 so as to be held by and insulated with the housing 2 through the insulator 3. A leading end portion of the center electrode 4 is exposed out of the leading end portion 3*b* of the insulator 3.

The leading end portion 3*b* of the insulator 3 is provided with a diametrically reduced insulator portion 3*c* whose diameter is nearly uniform in an axial direction and is smaller than a diameter of a base insulator portion of the leading end portion 3*b*, as shown in FIG. 2.

The center electrode 4 is a column whose inner member is composed of metal material having good thermal conductivity such as copper and whose outer member is composed of metal material having good heat resistance and corrosion endurance such as Ni base alloy. As shown in FIG. 2, the front end of the center electrode 4 is exposed out of the diametrically reduced insulator portion 3*c*. An end of a base electrode portion 4*a* is integrally connected to a first diametrically reduced electrode portion 4*b* whose diameter is smaller than that of the base electrode portion 4*a*. Further, a noble metal chip 10 constituting a second diametrically reduced electrode portion is arranged at a leading end of the first diametrically reduced electrode portion 4*b*. A base point X showing a boundary of the first diametrically reduced electrode portion 4*b* and the noble metal chip 10 (the most nearest point from the front end of the insulator 3 where the diameter of the center electrode 4 is reduced to constitute an edge) is located inside by 0.15 mm from the front end of the diametrically reduced insulator portion 3*c*.

As shown in FIGS. 2 and 3, a first ground electrode 5 and second ground electrodes 6 and 7 are fixed respectively by welding to the leading end of the housing 2. Each end of the second ground electrodes 6 and 7 is positioned on a circle whose diameter is larger by a distance C than an outside diameter of the diametrically reduced insulator portion 3*c*. The first and second ground electrode 5, 6 and 7 are composed of Ni base alloy.

The first ground electrode 5 faces the noble metal chip 10 to constitute a first discharge gap between a front end surface or edge of the noble metal chip 10 and a leading end side surface or edge of the first ground electrode 5. Each of the second ground electrodes 6 and 7 also faces the noble metal chip 10 and the insulator 3 to constitute a second discharge gap between a side surface or edge of the noble metal chip 10 and a front end surface or edge of the second electrode 6 or 7 through the insulator 3 (the diametrically reduced insulator portion 3*c*).

The noble metal chip 10 formed at the leading end portion of the center electrode 4 is made of Ir alloy (90 Wt % Ir-10 Wt % Rh in this embodiment). On the other hand, a chip 11 made of Pt alloy (90 Wt % Pt-10 Wt % Ni in this embodiment) is bonded by resistance welding to the surface of the ground electrode 5 at the first discharge gap.

Preferable dimensional relationships among component parts of the spark plug 1 according to the first embodiment are described below with reference to FIG. 2. A distance A of the first discharge gap is 1.1 mm, a radial thickness B of the front end of the insulator 3 (diametrically reduced insulator portion 3*c*) is 1.0 mm, a shortest distance C between a side surface of the insulator 3 (the diametrically reduced insulator portion 3*c*) and the front end of the second electrode 6, 7 is 0.6 mm, a shortest distance D between the base point X of the noble metal chip 10 and the inside front end of the insulator 3 (the diametrically reduced insulator portion 3*c*) is 0.3 mm, an axial length E from the inside front end of the insulator 3 (the diametrically reduced insulator portion 3*c*) to the base point X of the noble metal chip 10 is −1.5 mm (shown as + mark if the base point X protrudes out of the inside front end of the insulator 3), and an axial length F from the front end of the insulator 3 (the diametrically reduced insulator portion 3*c*) to a front end of the second electrode 6, 7 on a side of the housing 2 is −0.3 mm (shown as + mark if the front end of the second electrode 6, 7 on a side of the housing 2 protrudes out of the front end of the insulator 3).

As a test result of the sparkplug according to the first embodiment, a distance H of surface creeping discharge through the front end of the insulator 3 was 1.2 mm and ignitability and channeling suppressing function were satisfactory.

Figure 4:
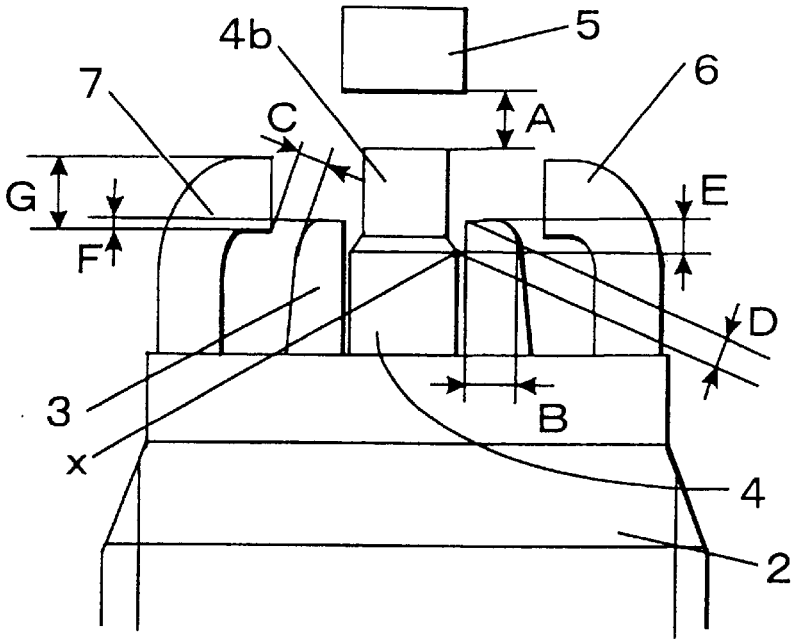
FIG. 4 is a partly enlarged elevation view of a spark plug according to a second embodiment of the present invention.

FIG. 4 shows a spark plug according to a second embodiment of the present invention which is a modification of the first embodiment. According to the second embodiment, the first diametrically reduced electrode portion 4*b* without the noble metal chip 10 is exposed out of the front end of the insulator 3. Further, though the base point X of the first embodiment is a boundary of the first diametrically reduced electrode portion 4*b* and the noble metal chip 10, the base point X according to the second embodiment is a boundary of the base electrode portion 4*a* and the first diametrically reduced electrode portion 4*b* (the most nearest point from the front end of the insulator 3 where the diameter of the center electrode 4 is reduced to constitute an edge). Furthermore, instead of the diametrically reduced insulator portion 3*c* in the first embodiment, the insulator 3 according to the second embodiment has a tapered outside surface portion. Therefore, according to the second embodiment, to define the shortest distance D or the axial length E or F of the spark plug according to the second embodiment, the base point X of the first diametrically reduced electrode portion 4*b* may be used in place of the base point X of the noble metal chip 10 as illustrated in the first embodiment.

Figure 5:
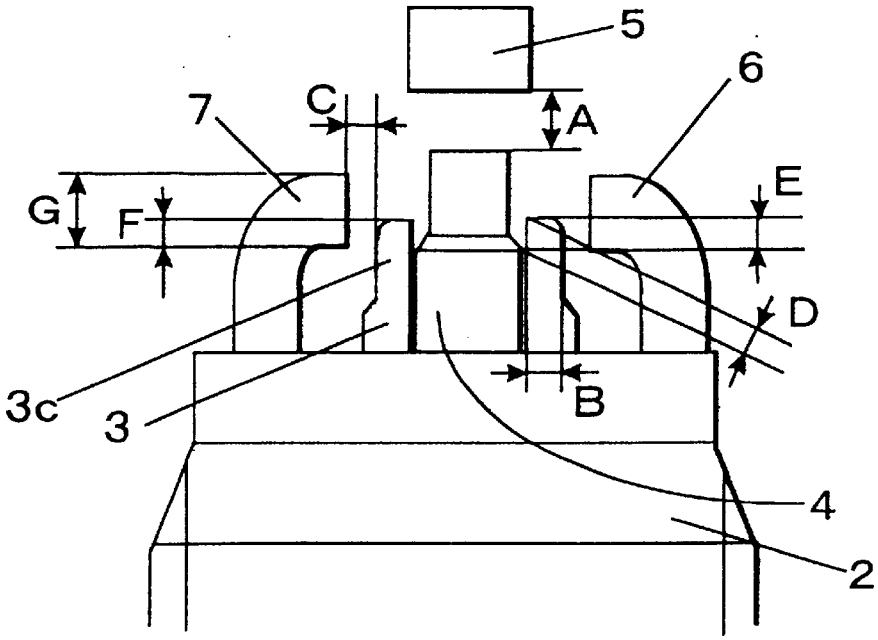
FIG. 5 is a partly enlarged elevation view of a spark plug according to a third embodiment of the present invention.

FIG. 5 shows a spark plug according to a third embodiment of the present invention that is a modification of the first embodiment. According to the third embodiment, the first diametrically reduced electrode portion 4*b* without the noble metal chip 10 is exposed out of the front end of the insulator 3 as shown in the second embodiment. The insulator 3 is provided with the diametrically reduced insulator portion 3*c* as shown in the first embodiment.

Figure 6:
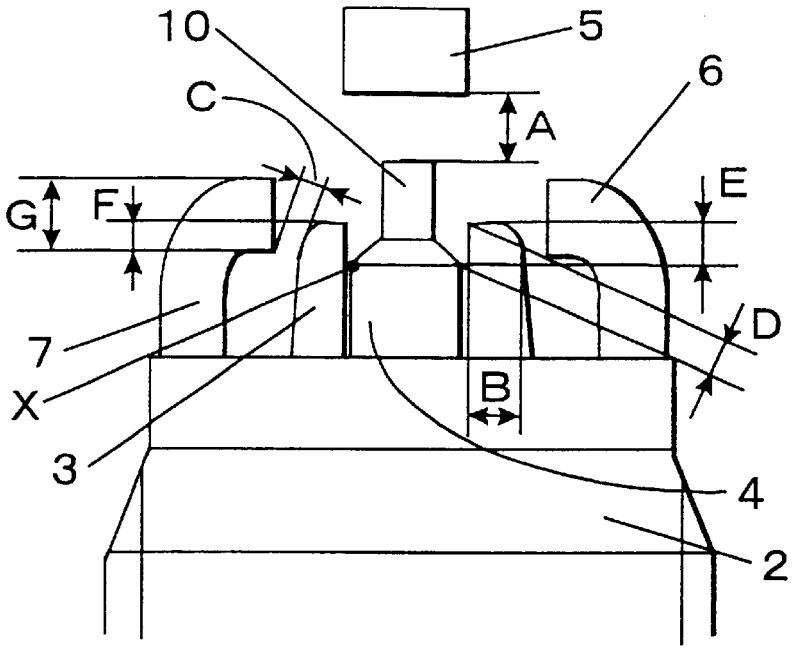
FIG. 6 is a partly enlarged elevation view of a spark plug according to a fourth embodiment of the present invention.

FIG. 6 shows a spark plug according to a fourth embodiment of the present invention that is a modification of the first embodiment. Instead of the diametrically reduced insulator portion 3*c* in the first embodiment, the insulator 3 according to the second embodiment has a tapered outside surface portion as shown in the second embodiment. The noble metal chip 10 is arranged at the leading end of the first diametrically reduced electrode portion 4*b* as shown in the first embodiment.

The spark plug according to the second, third or fourth embodiment has dimensional relationships among component parts thereof as disclosed in the first embodiment and it has been proved by experimental tests to have same function and effect as the first embodiment with respect to ignitability and channeling suppressing function.

Though Ir alloy including 10 weight percent Rh is employed as the noble metal chip 10, other noble metal material such as pure Ir or Pt or Pt alloy may be employed to achieve the same function and effect as disclosed in the above embodiments.

Next, to explain more in detail the present invention, the preferable range of each of the dimensions mentioned above is described hereinafter based on the experimental test results and studies thereof.

(Regular Spark Discharge Through the First Discharge Gap)

The test was conducted to find out a dimensional relationship among the respective components of the spark plug to satisfy conditions that regular spark discharge occurs through the first discharge gap between the noble metal chip 10 of the center electrode 4 and the first ground electrode 5 in order to ignite fuel in a combustion chamber without fail and, when the end of the insulator 3 is fouled by carbon deposit, a spark discharge occurs through the second discharge gap between the center electrode 4 and the second ground electrode 6, 7 in order to burn carbon deposited on and to cleanup surfaces of the insulator 3.

Figure 7:
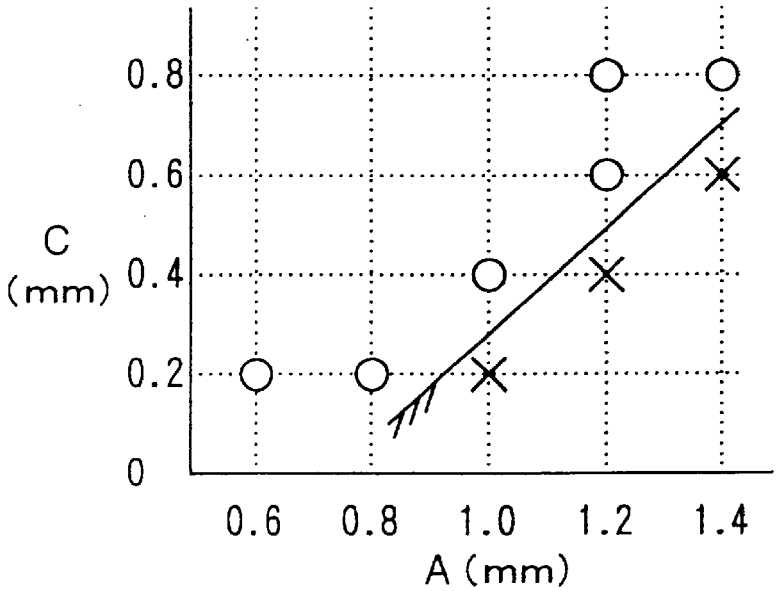
FIG. 7 is a graph showing the relationship between a first spark discharge gap A and a shortest distance C.

FIG. 7 shows the test result, which illustrates a region of the distance A of the first discharge gap in relation to the shortest distance C between the insulator and the second electrode 6, 7 where reliable discharge occurs through the first discharge gap when the insulator is not fouled.

In FIG. 7, a mark ○ shows the occurrence of spark discharge through the first discharge gap and a mark x show the occurrence of spark discharge through the second discharge gap. The radial thickness B of the front end of the insulator 3 is 1.0 mm and the shortest distance D between the base point X of the center electrode and the inside front end of the insulator 3 is 0.2 mm.

It may be understood from the test result shown in FIG. 7 that, as a condition for causing the spark discharge through the first discharge gap when the insulator is not fouled, it is necessary to satisfy the following formula;

$$A \leqq (C+D)+0.5B$$

(Spark Discharge Through the Second Discharge Gap when Fouled)

Figures 8, 9:
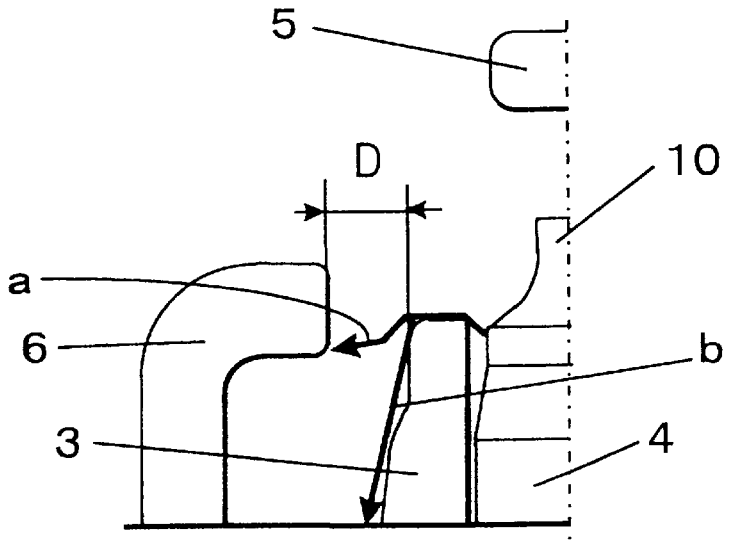
FIG. 8 is a chart showing the relationship between the shortest distance C and a spark discharge mode.
FIG. 9 is a view showing a change of spark discharge modes according to changes of the shortest distance C.

As a result of a bench test under 6 atmospheric pressure, FIG. 8 shows various modes of spark discharge when the insulator 3 is fouled by carbon deposited thereon on a condition that the distance A of the first discharge gap is 1.4 mm. A mark ○ shows the occurrence of spark discharge a through the second discharge gap as shown in FIG. 9, a mark x shows the occurrence of spark discharge b between the center electrode 4 and the housing as shown in FIG. 9 and a mark Δ shows mixed occurrences of both the spark discharges a and b.

As shown in FIG. 8, if the shortest distance C between the insulator 3 and the second ground electrode 6, 7 is not more that 1.6 mm, the spark discharge a occurs and the preferable shortest distance C is not more than 1.2 mm for always securing the spark discharge a.

(Suppressing the Occurrence of Channeling)

Figure 12A:
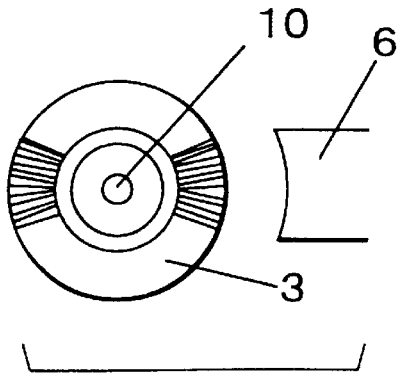
FIG. 12A PRIOR ART
FIG. 12A is a part view of an insulator as viewed in an axial direction of a center electrode for channeling explanation.
Figure 12B:
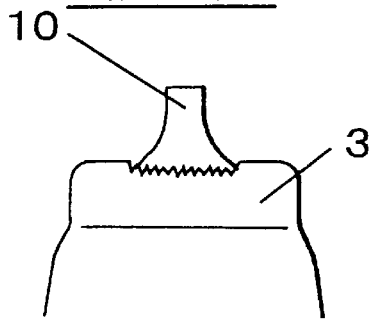
FIG. 12B PRIOR ART
FIG. 12B is a side view of an insulator for channeling explanation.

When the insulator 3 is fouled by carbon, the carbon is burned out by the spark discharge through the second discharge gap, which occurs so as to creep along the surface of the insulator 3, so that the surface of the insulator 3 may be cleaned up. However, the surface creeping spark discharge along the surface of the insulator 3 is likely to cause the channeling in such a way that the insulator 3 is scratched so as to form grooves therein as shown in FIGS. 12A and 12B. When the channeling occurs, spark of the spark discharge through the second discharge gap gets into the grooves. As a result, the ignitability gets worse and, further, heat endurance of the spark plug is decreased since heat is likely to be stagnant at edges of the grooves formed on the end surface of the insulator 3.

Figure 10:
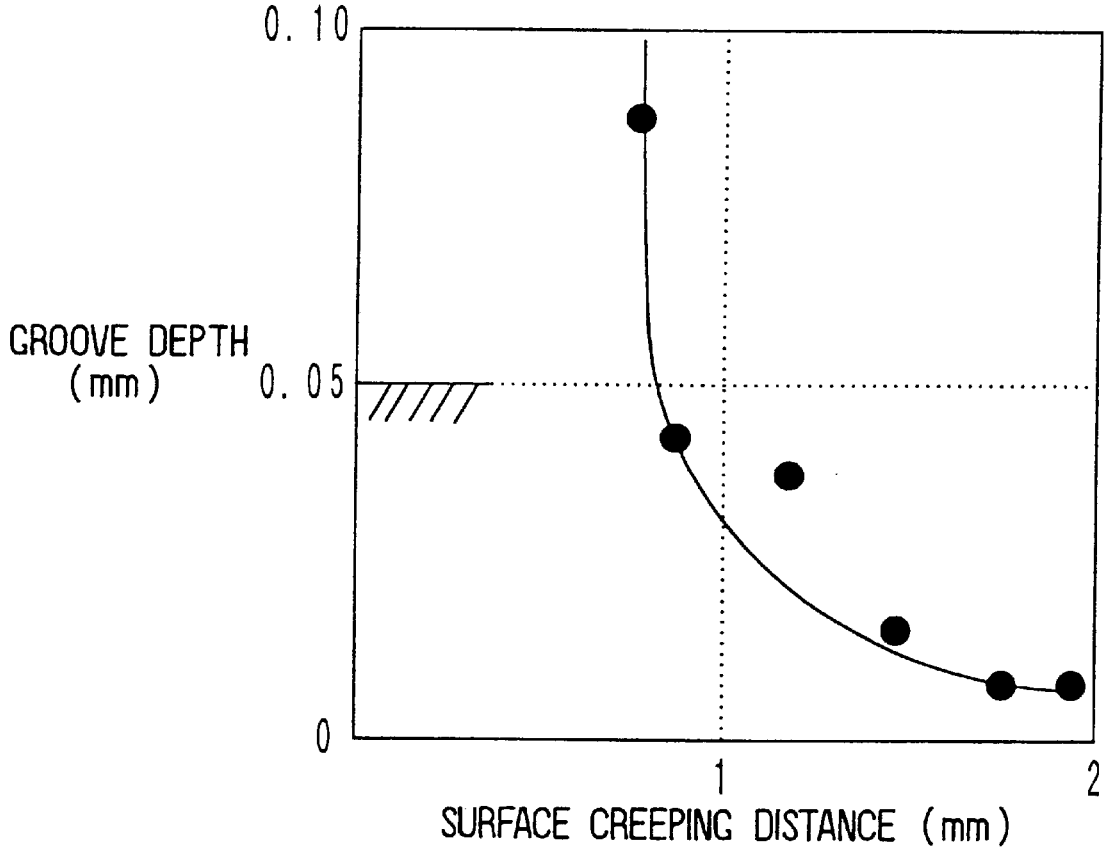
FIG. 10 is a chart showing a relationship between a surface creeping spark discharge distance H and a groove depth.

To investigate this problem, a test was conducted to find out a dimensional relationship among the components of the spark plug in which carbon is burned out and the formation of the grooves due to the channeling is suppressed when the surface creeping spark discharge along the end surface of the insulator 3. FIG. 10 shows the test result.

The test result proves a relationship between a distance H of spark discharge creeping along the end surface of the insulator 3, which is shown in a horizontal line of FIG. 10, and a depth of groove formed on the end surface of the insulator 3 due to channeling, which is shown in a vertical line thereof.

The above spark discharge endurance test was conducted under a condition that spark has been discharged at the second discharge gap under 4 atmospheric pressure and with 60 Hz interval for 150 hours.

To secure the spark plug having an anti-channeling effect that the groove depth is less that 0.05 mm after the endurance test, it may be concluded according to the test result that more than 0.9 mm distance of the spark discharge along the end surface of the insulator 3 becomes necessary. This is due to a reason that, as the surface creeping distance H along the end surface of the insulator 3 is longer, entire energy density of the spark discharge is lowered. Accordingly, the groove formation on the end surface of the insulator 3 may be limited, resulting in suppressing the generation of channeling.

To study more detail conditions of suppressing the generation of channeling, another test was conducted. The test is described with reference to FIG. 11.

Figure 11:
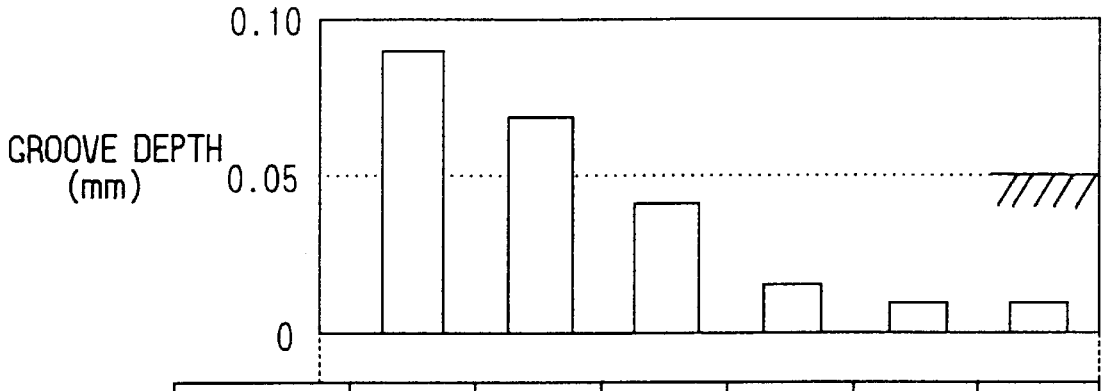
FIG. 11 is a chart showing changes of the groove depth according to changes of the axial lengths E and F.

FIG. 11 shows, as a result of a test similar to that shown in FIG. 10, a depth change of groove formed on the end surface of the insulator 3 due to channeling according to various changes of an axial length E from the inside front end of the insulator 3 to the base point X of the center electrode 4 (shown as + mark if the base point X protrudes out of the inside front end of the insulator 3) and an axial length F from the front end of the insulator 3 to a front end of the second electrode 6, 7 on a side of the housing 2 (shown as + mark if the front end of the second electrode 6, 7 on a side of the housing 2 protrudes out of the front end of the insulator 3). A radial thickness B of the front end of the insulator 3 is 0.9 mm.

It may be concluded that, if the distance of the spark discharge creeping along the end surface of the insulator is sufficiently long to an extent that the following condition is satisfied, the groove formation due to channeling may be limited;

$$|B|+|E|+|F| \geqq 1.2 \text{ mm}$$

(Other Conditions)

It is preferable that the radial thickness B of the front end of the insulator 3 is not less than 0.6 mm. If the thickness B is less than 0.6 mm, an insulation between the center electrode 4 and the housing 2 is not sufficient so that spark may be discharged from the center electrode 4 via the insulator 3 directly to the housing 2.

Further, it is preferred that the axial length E from the inside front end of the insulator 3 to the base point X of the center electrode 4 is not more than 0 mm (that is, the base point X does not protrude out of the inside front end of the insulator 3). If the axial length E is more than 0 mm, the distance of spark discharge creeping along the surface end of the insulator 3 is not sufficiently long so that channeling may not be suppressed.

Moreover, it is preferred that the axial length F from the front end of the insulator 3 to a front end of the second electrode 6, 7 on a side of the housing 2 is not more than 0 mm (that is, the front end of the second electrode 6, 7 on a side of the housing 2 does not protrude out of the front end of the insulator 3) and is not larger as an absolute value than a half of axial thickness G of a front end of the second electrode 6,7. If the axial length F is larger as an absolute value than the half of axial thickness G, spark is discharged to an end of the second electrode 6,7 on an opposite side of the housing 2 so that the surface creeping distance for spark discharge is not sufficiently large.

Further, if the axial length F is larger as an absolute value than the axial thickness G, fuel is bridged between the second electrode 6,7 and the insulator 3, though the surface creeping distance may be sufficiently long.

If the fuel is bridged as mentioned above, it becomes very difficult to generate spark discharge between the second electrode 6,7 and the center electrode 4 when the insulator 3 is fouled by carbon on the end of the insulator 3. Therefore, self-cleaning function of the spark plug may be harmed.

As mentioned above, the spark plug incorporating the present invention has a characteristic that an air-gap spark discharge with a good ignitabilty usually occurs at a first discharge gap and, when the insulator is fouled, a surface creeping spark discharge occurs at a second discharge gap to burn carbon deposited on the surface of the insulator, while the channeling on the surface of the insulator is limited.

What is claimed is:

1. A spark plug for internal combustion engine comprising;

a center electrode having a base portion, a diametrically reduced portion whose base point is integrally connected to an end of the base portion, and a front end;

an insulator having a front end, the insulator surrounding and holding the center electrode so as to expose both the front end and the diametrically reduced portion of the center electrode out of the front end thereof;

a metal housing having a leading end, the metal housing holding the insulator so as to expose the front end of the insulator out of the leading end thereof;

a first ground electrode having a leading end and a front end, the leading end of the first ground electrode being fixed to the leading end of the metal housing so as to constitute a first discharge gap between the front end of the first ground electrode and the front end of the center electrode; and a second ground electrode having a leading end and a front end, the leading end of the second ground electrode being fixed to the leading end of the metal housing and the front end of the second ground electrode being positioned radially outside the front end of the insulator so as to constitute a second discharge gap between the front end of the second ground electrode and the diametrically reduced portion of the center electrode, wherein dimensional relationships of the center electrode, the first and second ground electrodes, the insulator and the metal housing are respectively in ranges of;

$$A \leqq (C+D)+0.5\ B$$

$B \geqq 0.6$ mm $C \leqq 1.6$ mm $E \leqq O$ $-0.5\ G \leqq F \leqq O$ $|B|+|E|+|F| \geqq 1.2$ mm where A is a distance of the first discharge gap, B is a radial thickness of the front end of the insulator, C is a shortest distance between the insulator and the front end of the second electrode, D is a shortest distance between the base point of the center electrode and an inside front end of the insulator, E is an axial length from an inside front end of the insulator to the base point of the center electrode that is shown as + mark if the base point protrudes out of the inside front end of the insulator, F is an axial length from the front end of the insulator to the front end of the second electrode on a side of the housing that is shown as + mark if the front end of the second electrode on a side of the housing protrudes out of the front end of the insulator, and G is an axial thickness of the front end of the second electrode.

2. A spark plug according to claim 1, wherein at least one of the first ground electrode and the center electrode is provided with a noble metal chip at a portion where the first spark gap is constituted.

3. A spark plug according to claim 3 or 2, wherein the noble metal chip is made of any one material of pure Pt, pure Ir, Pt alloy and Ir alloy.

* * * * *